United States Patent [19]

Bach et al.

[11] 4,115,289

[45] Sep. 19, 1978

[54] DRY POWDERED OR LIQUID DEVELOPER COMPOSITIONS

[75] Inventors: Frederick O. Bach, Costa Mesa, Calif.; Leo N. Chapin, Park Ridge; Robert Freed, Lincolnwood, both of Ill.

[73] Assignee: A. B. Dick Company, Chicago, Ill.

[21] Appl. No.: 666,872

[22] Filed: Mar. 15, 1976

Related U.S. Application Data

[60] Continuation-in-part of Ser. No. 385,101, Aug. 2, 1973, abandoned, which is a continuation of Ser. No. 156,982, Jun. 25, 1971, abandoned, which is a division of Ser. No. 836,415, Jun. 25, 1969, Pat. No. 3,630,729.

[51] Int. Cl.[2] ..... G03G 9/10; G03G 9/12

[52] U.S. Cl. ..... 252/62.1 P; 96/1.2; 96/1.4; 252/62.1 L

[58] Field of Search ..... 252/62.1 R, 62.1 L, 252/62.1 P, 8.8; 96/1.2, 1.4

[56] References Cited

U.S. PATENT DOCUMENTS

| | | | |
|---|---|---|---|
| 3,262,806 | 7/1966 | Gourge | 252/62.1 |
| 3,272,644 | 9/1966 | Nelson | 252/62.1 |
| 3,320,169 | 5/1967 | East et al. | 252/62.1 |
| 3,473,923 | 10/1969 | Ohkubo et al. | 252/62.1 |
| 3,577,345 | 5/1971 | Jacknow et al. | 252/62.1 |
| 3,635,704 | 1/1972 | Palermiti et al. | 252/62.1 |
| 3,644,204 | 2/1972 | Heins et al. | 252/8.8 |
| 3,647,696 | 3/1972 | Olson | 252/62.1 |
| 3,728,112 | 4/1973 | Chapin et al. | 252/62.1 L |
| 3,890,240 | 6/1975 | Hochberg | 252/62.1 |

*Primary Examiner*—George F. Lesmes
*Assistant Examiner*—Bruce H. Hess
*Attorney, Agent, or Firm*—McDougall, Hersh & Scott

[57] ABSTRACT

An electrophotographic process and materials for the production of multi-color copies of a multi-color original in which an electrostatic charge is applied to a receptor sheet having a face portion subdivided into photoconductive segments containing sensitizing components in interspersed segments which cover different portions of the visible light spectrum and in which each such segment contains a solubilizable dye color corresponding to the color of the spectrum other than that to which the segment is sensitized and in which the exposed receptor is developed with a toner in which the dye component is soluble in response to toner activation for transfer of dye color from the developed receptor to copy sheets brought into surface contact therewith.

5 Claims, 6 Drawing Figures

DRY POWDERED OR LIQUID DEVELOPER COMPOSITIONS

This is a continuation-in-part of our copending application Ser. No. 385,101, filed Aug. 2, 1973 (now abandoned) as a continuation of application Ser. No. 156,982, filed June 25, 1971, now abandoned, which application was filed as a division of application Ser. No. 836,415, filed June 25, 1969, now U.S. Pat. No. 3,630,729.

This invention relates to an electrophotographic process, materials and elements for the production of true color copies from multi-color originals with but a single exposure to light.

It is an object of this invention to provide a process for producing true color copies of multi-color originals by use of an electrophotographic technique which requires but a single exposure to light; which makes use of a single receptor sheet from which one or a number of multi-color copies can be produced; in which the multi-color copy is produced by transfer from the receptor sheet to copy sheets for true color reproductions, and it is a related object to provide a composition and elements for use in the practice of same.

These and other objects and advantages of this invention will hereinafter appear and for purposes of illustration, but not of limitation, an embodiment of the invention is illustrated in the accompanying drawings in which FIG. 1 is a top plan view of a portion of a receptor embodying the coatings applied in accordance with a preferred practice of this invention;

Figure 1:
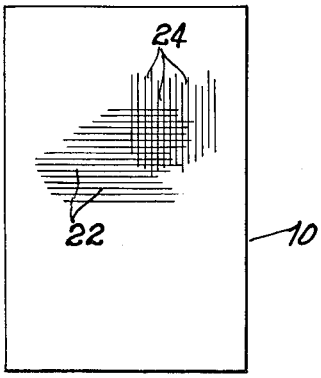
Figure 2:
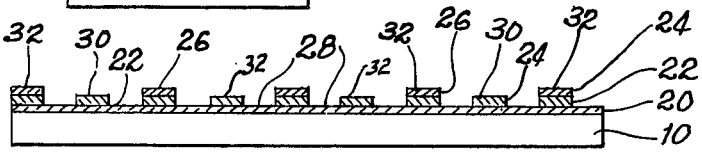
FIG. 2 is an enlarged sectional view through a portion of the receptor sheet shown in FIG. 1.

Briefly described, the concepts of this invention are practiced with a receptor provided with a number of photoconductive coatings each of which is formulated to contain (1) an organic insulating binder, such as an organo-silicon resin, a butadiene-styrene copolymer resin, a modified alkyd resin and the like; (2) a photoconductor such as photoconductive zinc oxide or other photoconductive material such as described in the Middleton et al. U.S. Pat. No. 3,121,006; (3) a sensitizing component, such as a sensitizing dye which sensitizes the photoconductor to light of a selected wave length within the visible light spectrum while reflecting wave lengths outside said range, with each coating containing a sensitizing ingredient which sensitizes the photoconductive coating to a different portion of the visible light range, whereby the total of the coating provides sensitivity which covers the entire visible light range, and (4) a soluble dye component in each coating having a color transfer value corresponding to the subtractive color for which the particular coating is sensitized, as represented by a color produced by the combination of ranges of light reflected by the sensitized photoconductor of the particular coating composition and in which the concepts of this invention include the use of a developer which is formulated with a component, normally identified as a toner, which comprises a colorless solid material in finely divided form of from 2–30 microns with most of the toner particles in the range of 5–25 microns, in which, in response to activation as by heat, solvent, vapors or the like, the toner functions as a solvent for the soluble dye component 4 of the photoconductive coating to effect transfer of the dye color from the portions of the coating immediately underlying the activated solvent for transfer to copy sheets pressed into surface contact with the receptor to produce true color copies of multi-color originals in response to a single exposure.

By way of illustration, the visible spectrum may be subdivided into contiguous segments, preferably three or more segments, such as subdivision of the visible light spectrum, assumed to be included within the range of 400–700 nm, into segments of about 400–500, 500–600 and 600–700 nm. The sensitizing component for one coating would then be selected to sensitize the photoconductor to light of within the range of 400–500 nm (blue sensitivity) and to reflect light within the range of 500–700 nm. This particular effect can be achieved by the use of a dyestuff corresponding to the yellow layer in the well known photographic color processes based upon the substractive tri-pack, such as Auramine O (C.I. 41,000). The soluble dye component formulated into the described coating composition is selected of a dyestuff having a yellow color or a color which represents the combination of the reflected light range of 500–700 nm.

Another or second coating is formulated with a sensitizing component effective to sensitize the photoconductor in the light range of 500–600 nm (green sensitivity), while reflecting light within the range of 400–500 nm and 600–700 nm. This can be achieved by the use of a magenta coating, when reference is made to the subtractive tri-pack system, such as by formulating the coating composition to contain acridine red (C.I. 45,000). The soluble dye component formulated into the described coating would be selected of a dyestuff having preferably a blue-red color corresponding to the combination of the reflected light within the range of 400–500 and 600–700 nm.

The third coating would be formulated to contain a sensitizing component which sensitizes the photoconductor to absorbed light within the range of 600–700 nm (red sensitivity), while reflecting light within the range of 400–600 nm. This can be achieved by a cyan coat, such as with Patent Blue (C.I. 42045). The soluble dye component in the third coating would be selected of a dyestuff giving a blue-green color corresponding to the range of reflected light or the combination of colors within the range of 400–600 nm.

When based upon the amount of photoconductive zinc oxide, the described coating compositions can be formulated to contain the resinous binder in an amount within the range of 10–40 parts by weight of resinous binder per 100 parts by weight of zinc oxide, and preferably in an amount within the range of 15–30 parts by weight of resinous binder per 100 parts by weight of zinc oxide. The sensitizing component or dyestuff is formulated in the coating composition in an amount within the range of 0.001 to 5.0 part by weight per 100 parts by weight zinc oxide and preferably within the range of 0.01 to 2.5 part by weight per 100 parts by weight of zinc oxide, the amount depending somewhat upon the sensitizing dye, such as 0.13% by weight magenta color, as in the form of acridine red having a spectral response in the range of 495–620 Å, 0.06% of the cyan color, as represented by Patent Blue having a spectral response in the range of 600–700 Å, and 1.2% by weight of the yellow color as represented by Auramine O having a spectral response within the range of 405–500 Å. It will be understood that, except for cost, more than 5.0 parts by weight of sensitizer per 100 parts by weight zinc oxide can be used. The soluble dye component can be formulated into each coating in an amount within the range of 0.5–20.0 parts by weight per 100 parts by weight of zinc oxide and preferably in an amount within the range of 1–5 parts by weight per 100 parts by weight of zinc oxide. The foregoing amounts of sensitizer and soluble dye components specified in parts by weight may be taken as corresponding to the percent by weight of the photoconductive coatings formulated of photoconductive zinc oxide or a photoconductor other than zinc oxide, but in which the percentage is adjusted by the weight ratio of zinc oxide to said other photoconductive material in the coating.

The soluble dye component is preferably formulated in the respective coating compositions as a dispersed dye but it will be understood that the soluble dye component can be incorporated in other states.

The coatings are produced from compositions containing the described components in combination with a diluent which is a solvent for the resinous binder and application may be made to the substrate in coating weights, when formulated of a zinc oxide photoconductor, within the range of 8–40 pounds per 3,000 square feet of surface area, and preferably within the range of 15–30 pounds per 3,000 square feet of surface area.

The separate coating compositions are applied or otherwise imprinted on the surface of the substrate in various patterns. The essential requirement is that the face of the coated substrate define a final pattern of separate, small light responsive areas of each coating interspersed one with another substantially uniformly over the surface of the substrate in closely spaced relation.

This can be accomplished by application of the separate coating compositions in a pattern of dots, circles, beads, spheres, squares, lines or the like configurations. Since it is not essential that the separate light responsive areas be arranged coplanar, it is preferred to apply the coating compositions either in the form of lines which criss-cross one another over the surface of the substrate or more preferably to apply one coating composition as a continuous coating over the surface of the substrate and to apply the remaining coatings as lines which criss-cross over the underlying base coat as islands or dots of various configuration which overlie the base coat. Thus the receptor sheet will be formed of a substrate having portions coated with only one layer of the first coating, other portions with two layers formed of the first and second coats and first and third coats; and still other portions formed of three layers of the first, second and third coating, etc.

Having described the basic concepts of the invention from the standpoint of compositions and construction of the elements employed, illustration will now be made by way of examples which represent the practice of the invention and in the utilization thereof in carrying out the new and novel process for multi-color reproduction of multi-color originals by the electrophotographic technique. The description will hereinafter be made with respect to a system of compositions based upon the substractive tri-pack, but it will be understood that the visible light spectrum can be otherwise divided for the selection of component identified as the sensitizing component and corresponding soluble dye component embodied in each of the separate coating formulations.

EXAMPLE 1

Magenta coating composition: (green sensitive):
- 100 grams photoconductive zinc oxide (Photox 80 — New Jersey Zinc Company)
- 25 grams modified alkyd resin (DeSoto E-104-13A — DeSoto Chemical Coatings, Inc.)
- 0.13 gram sensitizing dye — Acridine Red — C.I. 45000 (Allied Chemical Corp.)
- 1.5 grams dispersed dye — spirit soluble Fast Red 3B (Allied Chemical Corp.)
- 60 ml toluene

EXAMPLE 2

Yellow coating composition (blue sensitive):
- 100 grams photoconductive zinc oxide (Photox 80)
- 25 grams modified alkyd resin (DeSoto E-104-13A)
- 0.05 gram sensitizing dye — Auramine O — C.I. 41000 (Allied Chemical Corp.)
- 1.5 grams dispersed dye — Calcofast Spirit Yellow TG (American Cyanamid Company)
- 60 ml solvent — toluene

EXAMPLE 3

Cyan coating composition (red sensitive):
- 100 grams photoconductive zinc oxide (Photox 80)
- 25 grams modified alkyd resin (DeSoto E-104-13A)
- 0.05 gram sensitizing dye — Patent Blue — C.I. 42045 (Allied Chemical Corp.)
- 1.5 grams dispersed dye — spirit soluble Fast Blue 6G (Allied Chemical Corp.)
- 60 ml solvent — toluene In each of the examples, the resinous binder, zinc oxide and solvent are first blended together by mixing for about 5 minutes. The sensitizing dye, in solution in methanol, is added and blended by mixing for about 1 minute. The dispersed dye is finally added and blended with mixing for about 1 to 2 minutes.

The first coating 20, which may be the magenta coat of Example 1, is applied either by a roller coater, by a metering rod, or by hand draw-down with a wire wound rod, onto Weyerhauser Base A paper 10 in a coating weight of about 20 pounds per 3,000 square feed, and then dried. The yellow coating composition of Example 2 is applied, as by silk screen, in a coating weight of about 15 pounds per 3,000 square feet of surface area in a pattern of closely spaced parallel lines 22 which extend crosswise over the surface of the first coating 20. It will be understood that the described coatings can be applied in various other sequences such as a first coating of the yellow coat of Example 2 followed by second and third coatings of Example 1 and 3, or a first coat of Example 3 and second and third coatings of Examples 3 and 2 or 2 and 3, etc.

The cyan coating composition of Example 3 is also applied, as by silk screen, in a coating weight of about 15 pounds per 3,000 square feet of surface area in a pattern of closely spaced parallel lines 24 which extend lengthwise over the first and second coatings to provide cross-over points 26 having three thicknesses of coating with the third coating 24 uppermost on the face of the substrate or paper base sheet.

The final coated sheet constitutes a receptor suitable for use in the practice of this invention with separate sections 28 having a single coating thickness of the magenta coating, separate sections 30 having a double coating thickness formed of a lowermost magenta coating 20 and an uppermost yellow coating 22 and a lowermost magenta coating 20 and an uppermost cyan coating 24 and still other sections 32 having a triple coating thickness formed of a lowermost magenta coating 20, an intermediate yellow coating 22 and an uppermost cyan coating 24. Thus the exposed face of the receptor presents separate sections of each of the coatings in substantially uniformly dispersed relation over the face of the receptor sheet.

The receptor sheet is charged in the usual manner, now well known to the electrostatic copy art, as by subjecting the face of the receptor to a corona spray as it is exposed to corona discharge from wires operating at a potential of about 6000 to 8000 volts. The charged wires, which extend across the face of the receptor, are either transported over the face of the receptor or the receptor is displaced beneath the wires. The electrostatic charge is deposited over the entire receptor covered by one or more of the photoconductive coatings.

The charged receptor is next exposed to the multicolor original. Such portions of the original which are blue in color, for example, will cause discharge of the corresponding areas on the face of the receptor formed of the yellow coating which is sensitized to blue, leaving the charges in the corresponding areas on the exposed face sections of the magenta and cyan coatings for subsequent development.

Figure 3:
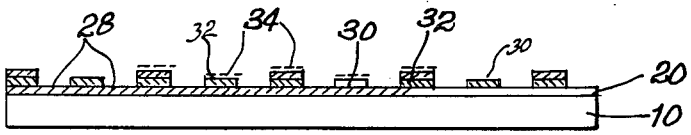
FIG. 3 is a schematic sectional view similar to that of FIG. 2, illustrating the conditions existing in response to exposure to a multi-color original.

The portions of the original which are green in color cause discharge of the corresponding areas 28 on the face of the receptor formed of the magenta coating, which are sensitized to green, leaving the charge 34 on the corresponding areas on the face sections 32 of cyan and sections 30 of yellow coating for subsequent development, as depicted in FIG. 3.

Similarly, the portions of the original which have the color red will cause discharge in the corresponding areas of the receptor of the cyan sections 32 on the exposed face of the receptor sheet which are sensitized to red, leaving the charges on the corresponding areas in the exposed face sections of magenta and yellow for subsequent development.

The exposed receptor sheet is developed in the conventional manner either with a dry powder developer or with a liquid developer, but in which the conventional particles of toner in the dry powder developer, or suspended in the liquid developer are substituted by finely divided particles of a compound which, when activated as by heat or solvent, vapor and the like, becomes a solvent for the dispersed dye in the coating. Use is made of toner particles which are substantially free of any color, other than white, so as not to interfere with the color development of the dye components within the coated receptor sheet. When, in the preferred practice of this invention, use is made of a liquid developer, the hydrocarbon liquid used as a carrier should have a volume electrical resistance in excess of $10^{10}$ ohms cm. The toner particles in the dry powder developer or in the liquid developer are selected to have a particle size within the range of 2–30 microns, with most of the particles within the range of 5–25 microns.

The following examples are given by way of illustration, but not by way of limitation, of liquid developing compositions embodying the features of this invention:

EXAMPLE 4

5.0 grams toner (Antipyrine)
400 ml liquid carrier (Isopar G — Humble Oil Co.)
5 grams charge director (Fuel Oil Additive #2 — DuPont)

EXAMPLE 5

5.0 grams toner (1-allyl-2-thiourea)
400 ml liquid carrier
5 grams charge director The Isopar G used as the liquid carrier in the above example is a paraffinic hydrocarbon liquid having 11.8% $C_9$ hydrocarbons, 56.2% $C_{10}$ hydrocarbons, 31.7% $C_{11}$ hydrocarbons, less than 0.3 aromatics and less than 0.1 olefins, a boiling point within the range of 318°–350° F., a flash point of 104° F. and a specific gravity of 0.748. Other liquid carriers used in liquid developers may be used as long as the toner compound is not dissolved therein. The Fuel Oil Additive #2 is a solution of a methacrylate copolymer having an average molecular weight of 50,000. Again, other conventional charge directors can be employed.

The antipyrine of Example 4 and the 1-allyl-2-thiourea of Example 5 are merely representative of suitable toner particles which may be used for development of the latent electrostatic image of the charged sections that remain after exposure. Other toner particles may be used which meet the requirements:

(1) a solvent for the soluble dye component in the coatings when the toner is in a molten or activated state;
(2) capable of being reduced to a finely divided form in which it is retained in the liquid or powdered developer composition;
(3) capable of taking on a charge, such as a positive charge when used with a charged photoconductive coating of zinc oxide;
(4) suitably located within the triboelectric series to produce the desirable charge development.

Representative of other suitable compounds which meet these requirements and can be used as toners are vanillin, 1,6-hexanediol, 1,10-decanediol, ethyl urea, acetamide, benzohydrol, 2,2-dimethyl-1,3-propanediol, ammonium acetate, ammonium formate and pyrazine. The toner particles can be employed in various concentrations in the developer composition, such as within the range of 2–20% by weight, and preferably 3–10% by weight, in a dry powder developer and within the range of 0.2–20% by weight and preferably 2–10% by weight in a liquid developer. When use is made of a dry powdered developer which is applied by brushing or the like, the toner concentration can range up to 100 percent by weight toner in the developer.

Figure 4:
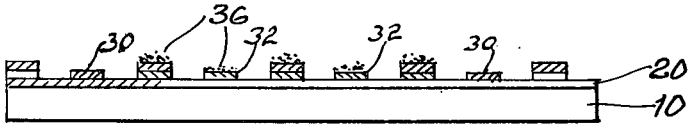
FIG. 4 is a schematic sectional view of the exposed receptor of FIG. 3 after treatment with a developer composition.

Continuing with the development process, in response to the application of the developer composition, toner particles 36 will be retained on the portions on the face of the receptor which remain charged to define the latent electrostatic image after exposure while the discharge sections on the face of the receptor will remain substantially free of the toner particles, as depicted in FIG. 4.

Thereafter the developer receptor sheet is pressed into surface contact with a copy sheet 40, as by passage of the composite assembly between compression rollers heated to a temperature above the melting point temperature for the toner, such as at a temperature above 111°–113° C. which is the melting point for antipyrine, or above a temperature of 77°–78° C. which is the melting point for 1-allyl-2-thiourea, and preferably by heating the toner particles to a temperature which exceeds their melting point by a slight amount preferably about 5°–10° F. As a result, the toner particles are reduced to a fluidized state to enable solution of the dispersed dye in the underlying portions of the photoconductive coating in the face of the receptor for transfer of the corresponding dye color, as by diffusion, from the receptor to the copy sheet 40.

Figure 5:
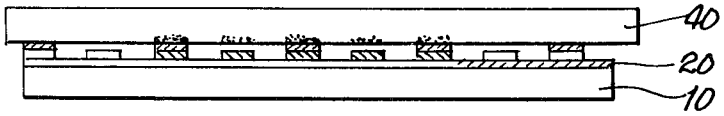
FIG. 5 is a schematic diagram showing the transfer of the multi-color image from the receptor to a copy sheet.
Figure 6:
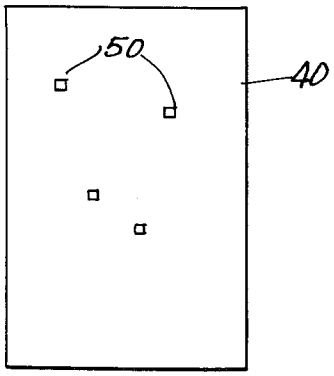
FIG. 6 is a top plan view of the multi-color copy produced from the exposed receptor of FIG. 5.

In the example illustrated in FIGS. 4 and 5, the cyan and yellow coatings 32 and 30, respectively, which remain charged and retain the toner particles 34 on development, solubilize the Calcofast Spirit Yellow TG and the Spirit Soluble Fast Blue 6G to cause transfer to the copy sheet with resultant reproduction 50 of the green color of the original. In such areas of the original which are black, such as the printed areas, none of the sections in the face of the coated receptor would become discharged upon exposure. As a result, each of the areas accept toner for transfer of dyestuffs from all of the three basic color sections which together appear black in the copy sheet.

It will be apparent that the copy produced by the combination of colors transferred from the developed receptor sheet will correspond to the colored original and that the developed receptor can function in a manner of a spirit master to produce multiple copies of the multi-color original, as by the successive passage of copy sheets into pressure contact with the developed receptor until the soluble dyestuff in the toned face segments are exhausted.

It will be apparent from the foregoing that we have provided a new and novel electrophotographic process for the production of true color copies of multi-color originals by the use of but a single exposure for the development of a master from which one or more multicolored copies can be produced.

It will be understood that changes may be made in the details of formulation, application and process steps without departing from the spirit of the invention, especially as defined in the following claims.

We claim:

1. A developer composition for color development of latent electrostatic imaged portions of an electrophotographic sheet having interspersed photoconductive sections sensitized in latent electrostatic imaged portions to different segments of the visible light spectrum and containing colorless dispersed solubilizable dye particles which produce color when reduced to the solubilized state corresponding to the portions of the visible light spectrum other than that for which the particular section is sensitized, said developer composition consisting of a substantially colorless finely divided developer compound having a particle size within the range of 2 to 30 microns and which is capable of acquiring a charge within the triboelectric series for attraction to the electrostatically sensitized segments of the receptor sheets, and which, when activated by heat, solvent or solvent vapors, is a solvent for the dye components in the receptor sheet, and the remainder of the developer composition consists of a carrier for the finely divided compound, in which the developer compound is present in an amount within the range of 2–100% by weight when in the form of a dry powdered developer composition and 0.2–20% by weight when the developer composition is liquid.

2. A developer as claimed in claim 1 in which the developer is a liquid developer containing the said developer compound in an amount within the range of 2–20% by weight, the remainder being a hydrocarbon liquid in which the finely divided compound is insoluble and is characterized by a volume electrical resistance in excess of $10^{10}$ ohms cm.

3. A developer as claimed in claim 2 in which the said developer compound is present in an amount within the range of 2–10% by weight of the developer composition.

4. A developer as claimed in claim 1 in which the finely divided substantially colorless developer compound is selected from the group consisting of vanillin, 1,6-hexane-diol, 1,10-decanediol, ethyl urea, acetamide, benzohydrol, 2,2-dimethyl-1,3-propanediol, ammonium acetate, ammonium formate, pyrazine, antipyrine, and 1-allyl-2-thiourea.

5. A developer as claimed in claim 1, in which the developer compound is present in an amount within the range of 3 to 10% by weight.

* * * * *